United States Patent [19]

McDowell, Jr.

[11] Patent Number: 4,545,182

[45] Date of Patent: Oct. 8, 1985

[54] ROTATING FILM WRAPPING APPARATUS WITH TRAVELING CLAMP

[76] Inventor: Kenneth J. McDowell, Jr., 9108 Elms Ct., Louisville, Ky. 40299

[21] Appl. No.: 478,311

[22] Filed: Mar. 24, 1983

[51] Int. Cl.[4] ..... B65B 13/04

[52] U.S. Cl. ..... 53/556; 53/588

[58] Field of Search ..... 53/556, 588, 587, 589; 100/27, 33 PB

[56] References Cited

U.S. PATENT DOCUMENTS

| | | | |
|---|---|---|---|
| 4,216,640 | 8/1980 | Kaufman | 53/556 |
| 4,317,322 | 3/1982 | Lancaster et al. | 53/556 |
| 4,432,185 | 2/1984 | Geisinger | 53/587 |

*Primary Examiner*—Francis S. Husar
*Assistant Examiner*—Jorji M. Griffin
*Attorney, Agent, or Firm*—Gipple & Hale

[57] ABSTRACT

A wrapping apparatus having a rotating ring which carries a film dispenser carriage adapted to dispense film web around a load carried on a wrapping conveyor. A traveling film clamp mechanism is mounted adjacent the wrapping conveyor and extends through the plane of the rotating ring to engage, clamp, cut and brush film web dispensed from the film dispenser carriage. The traveling film clamp mechanism incorporates a linear driver assembly, a fixed clamp jaw mounted to the linear driver assembly and positioned substantially parallel to the line of travel in which the linear driver operates, a rotating jaw mounted to the linear driver assembly adapted to close against the fixed jaw to clamp film web therebetween, and a rotating cutter brush arm carrying a leading cutter edge and a trailing brush. After the web is clamped between the fixed and rotating jaws, the cutter edge of the brush arm severs the web extending between the jaws, and the brush carries the severed web portion against underlying film web layers previously wrapped around the load to create a commercially viable seal, while the jaws clamp the film web so that wrapping of the next load may be initiated.

21 Claims, 11 Drawing Figures

ROTATING FILM WRAPPING APPARATUS WITH TRAVELING CLAMP

BACKGROUND OF THE INVENTION

The present invention generally relates to packaging and more particularly is directed to a rotating stretch wrapping apparatus for making unitary packages which incorporates a linear traveling clamping and cutting assembly.

Case packing or boxing is a common way of shipping multiple unit products. Multiple unit products are generally stacked in a corrugated box or are wrapped with kraft paper with the ends of the kraft paper being glued or taped.

Some manufacturers use strapping of vertical steel or plastic binding to unitize the product. The problems incurred in the use of strapping are the requirement of costly corner protectors, danger of bending or snapping and injury to the operator while applying this high tension material to the loads and the ever present problem of product settling due to moisture wetting the cartons, carton sides bulging or normal vibrations causing the straps to loosen and the load to come apart.

Glue is an alternative method used in some areas but customer dissatisfaction with gluing is high because removal of glued cartons or bags from the unitized loads tends to tear outside layers of the cartons. Glue, although an inexpensive material, demands interleaving for product orientation requiring more durable and expensive packaging material.

Tape, another alternative method of packaging, is currently being used to horizontally bind the top layer of the load. However, tape is expensive and allows relatively free movement of all product surrounded.

Another method of wrapping products is by putting a sleeve or covering of heat shrinkable material around the products and shrinking the sleeve to form a unitized package. The use of heat shrinkable film is described in U.S. Pat. Nos. 3,793,798; 3,626,645; 3,590,549 and 3,514,920. A discussion of this art is set forth in U.S. Pat. No. 3,867,806.

A rapidly growing economical way of packaging products is by wrapping the product load with a web of stretched plastic film.

The elasticity of the web of stretched plastic film holds the products of the load under more tension than either shrink wrap or kraft wrap, particularly with products which settle after packaging. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs. Virtually all stretch films on the market today including products of Mobil Chemical Company (Mobil-X, Mobil-C, Mobil-H), Borden Resinite Division PS-26, Consolidated Thermoplastics, Presto, PPD and others are consistently stretched significantly less than capacity because of irregularities in film brake systems. These systems depend upon friction induced drag either directly on the film through a bar assembly or indirectly as is shown in U.S. Pat. Nos. 3,867,806 and 4,077,179.

The use of wrapping machinery to wrap stretched film around a load is well known in the art. Four types of stretch wrapping apparatus are commonly used in the packaging industry and these types are generally described as spiral rotary machines, full web rotary machines, pass-through machines, and circular rotating machines.

An example of a spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

In U.S. Pat. No. 3,788,199, tapes are spirally wound in such a manner that they overlap each other to provide suitable space therebetween when breatheability is required. In this disclosure, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment, the tapes intersect each other at an angle of about 90°. The angle defined by the tapes constituting the cylindrical network may be determined by varying the interrelationship between the traveling speed of the endless belts carrying the tape and the rotating speed of the bobbin holders, which rotate a plurality of tape bobbins to deposit the tape onto the moveable belt.

Spiral wrapping machines which are currently commercially available are manufactured by Lantech, Inc., under Model Nos. SVS-80, SVSM-80, STVS-80, STVSM-80 and SAHS-80.

A full web type of apparatus which wraps stretched film around a rotating load is disclosed in U.S. Pat. No. 3,867,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured by Lantech, Inc.

Another type of machine for wrapping a pallet load commonly called a pass-through machine is disclosed in U.S. Pat. No. 3,596,434. In this reference, a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web and apply unitizing tension to the load, as is disclosed in U.S. Pat. No. 3,662,512. Another disclosure of relevance to pass-through wrapping is U.S. Pat. No. 3,640,048 which shows that film may be applied to the top and bottom of the pallet load prior to the wrapping cycle when it is desired to cover all six surfaces of the pallet load with film. Commercial pass-through machines are currently manufactured by Weldotron Corporation.

Various apparatus and processes have been developed to rotatably wrap stacked components to form a load.

Devices in which stationary loads are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting surfaces, wrapping the load and the supporting surfaces together. The plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the sides of the load. Further developments of this wrapping system are disclosed in U.S. Pat. Nos. 4,110,957 and 4,178,734.

U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping paper between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each item is conveyed along the surface of a horizontal sheet of wrapping material. The edges of wrapping material on each side of the item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied to an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap. Because the normal load of filaments or similar items is much longer than the wrapping area, it is not necessary to provide support for the bundle in the wrapping area.

Commercial circular rotating wrapping machines are presently manufactured by Lantech, Inc., under the trademark LANRINGER and are provided with wrapping ring inner diameters of 36 inches, 54 inches, 72 inches and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR and the continuous wrap or bundler models have the model designation SVCR and SAVCR.

One method of severing and sealing the film web at the end of the wrapping cycle is illustrated in U.S. Pat. No. 4,317,322 assigned to Lantech, Inc. In this reference, a pair of rotating clamp jaws are mounted beneath the wrapping conveyor, and a positioning and cutting assembly is pivotably mounted to swing into an area between the closed clamp jaws and the conveyor on the same side of the ring as the film supply. The positioning and cutting mechanism is driven upwards by a fluid cylinder and engages the film web angled between the edge of the conveyor and the film web supply roll mounted on the ring beneath the clamp jaws. The leading edge of the positioning and cutting mechanism engages the film web and carries it into position directly underneath the conveyor so that the web extends downward from the positioning and cutting mechanism to the supply roll through the area in which the clamp jaws will close. The clamp jaws are then activated to close and hold the film web between the positioning and cutting assembly and the roll. The positioning and cutting assembly includes a cutting edge mounted to a second fluid cylinder, the second cylinder being adapted to drive the cutting edge forward to sever the web after the jaws are activated to clamp and hold the web. A brush is also mounted to the positioning and cutting assembly and is directed upwards to brush the upper portion of the engaged film web against the underside of the conveyor and the prior layers of web wrapped there. The tackiness of the plastic film web holds the upper portion against the underlying layers and creates a commercially viable seal. The lower severed portion of the film web is held by the clamp jaws and extends from the jaws to the film roll. The positioning and cutting assembly is then pivoted out of the wrapping area, and the conveyor is activated to transport the load out of the wrapping area. Subsequently, another load may be delivered to the wrapping conveyor in the wrapping area, and the film web roll may be carried around the load and conveyor through at least one complete revolution. The clamp jaws are then rotated apart to release the severed end of film web, and the stretched tensioned web collapses against the underside of the conveyor.

The above described system suffers from a number of deficiencies. The system requires exact stopping of the roll in a specific position and, thus, deceleration of the ring and mounted roll takes a significant amount of time. Once the roll is stopped, the cutter arm is brought up from the bottom and the time involved for severing each wrapped package ranges from five (5) to ten (10) seconds a time consuming process. The film web roll must be mounted entirely on one side of a rotating ring apparatus which encircles the wrapping area, so that the width of film web does not extend through the ring plane. This is made necessary by the need to sever the entire width of film web between the clamps and the conveyor, as the pivotable positioning and cutting assembly cannot rise up through the ring plane to contact and cut the entire width of film web on both sides of the rotating ring. Thus, the shaft which carries the film web on the ring is subject to moment forces during stretching of the film web, and has a limited span of usefulness. Moreover, the positioning and cutting apparatus is energy inefficient in requiring the transportation of a substantial mechanical mass through a long arc. Control and power for the cutting edge cylinder must likewise be transported, which increases the complexity and number of moving parts inherent in the apparatus. Furthermore, the positioning and cutting apparatus must arrive at a precise location within the wrapping area in order to perform its purpose effectively, and the precise tolerances required of the fluid cylinder pivoting system increase the cost of the apparatus.

Therefore, it is clear that there exists a need in the art for a more energy-efficient, simplified and accurate mechanism for the clamping, cutting and brushing of film web at the end and beginning of each wrap cycle. Such a mechanism should preferably allow the film web roll to be mounted across the plane of the rotating ring, so as to reduce shear forces on the film roll shaft. The mechanism must therefore engage the width of the film web through the plane of the rotating ring, and not be limited to action only on one side of the ring.

SUMMARY OF THE INVENTION

According to the present invention, there is provided a rotatable film wrapping apparatus in which a rotating ring carries a film dispenser around a load riding downstream on a wrapping conveyor. The film dispenser carriage is mounted across the plane of the ring so as to dispense film web on both sides of the ring plane, thereby balancing the forces exerted at the dispenser-ring joint and avoiding destructive moment forces. The apparatus is faster than previous wrapping apparatuses as it cuts in a matter of a second since the cutting mechanism is started while the film is still moving. This apparatus does not require the film roll to be exactly stopped and positioned as was necessary in previous film wrapping apparatus. The wrapping conveyor is configured with a bottom surface to carry wrapped film web downstream together with the load. A film clamping mechanism is mounted adjacent the wrapping conveyor to move on a line parallel to the downstream direction through the ring plane, in order to engage, clamp, cut and brush film web dispensed during ring rotation.

At the end of a wrapping operation, the ring is halted with the film web extending from the load and conveyor to the dispenser through the line of travel of the traveling clamp mechanism. The traveling clamp mechanism includes a linear drive, a fixed clamp jaw mounted to the linear drive and positioned substantially parallel to the line of travel, a rotating jaw adapted to clamp against the fixed jaw and hold the film web therebetween, and a rotating cutter brush arm provided with a leading cutter edge and a trailing brush. After the web is clamped between the jaws, the cutter edge severs the web extending to the load, and the brush brushes the severed web against underlying tacky web layers to create a commercially viable seal. The clamp jaws remain closed to hold the web extending from the dispenser until the wrapping conveyor has transported the load and film web to a take-off conveyor. When a new load is conveyed into the wrapping area, the ring is rotated until at least one layer of film web is wrapped around the load, conveyor and traveling clamp apparatus. The rotating jaw is then opened slightly to release the film web, and the traveling clamp mechanism is withdrawn from the wrap, thereby allowing the film web to collapse against the bottom side of the wrapping conveyor.

These and other objects and advantages of the present invention will be more clearly understood by reference to the accompanying detailed description thereof, when read in conjunction with the drawings appended hereto.

DETAILED DESCRIPTION OF THE DRAWINGS

Figure 1:
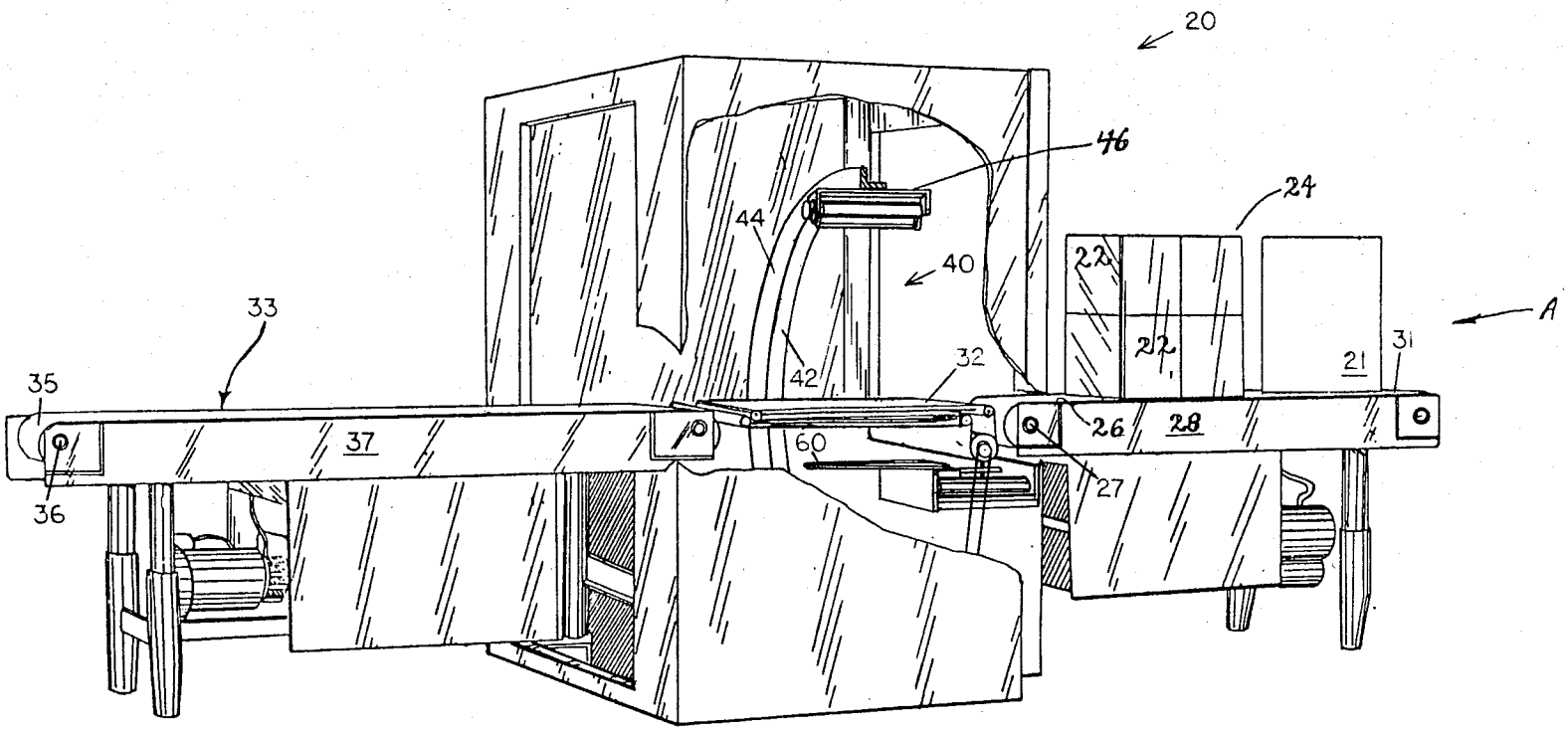
FIG. 1 is a side perspective view of an apparatus constructed according to the present invention, partially cut-away to reveal details thereof.

The best mode and preferred embodiment of the present invention is disclosed in FIGS. 1 through 11, which show a ring wrapping apparatus, generally indicated at 20, comprising an infeed conveyor 31, a wrapping conveyor 32, a take-off conveyor 33, a film dispensing mechanism 42 and a traveling clamp assembly 60.

As shown in FIG. 1, a plurality of cartons 22 forming a load 24 are loaded in a stacked relationship on an infeed conveyor 31 by either manual or mechanism means. It should be noted that the load, depending on its nature and composition, may or may not require spacing. A loading device 21, which is well-known in the art, is indicated schematically and may be any of a number of stacking or placing devices which are used to place a stack of cartons or materials into designated areas.

In the preferred embodiment, the load 24 is initially placed on the infeed conveyor 31. The conveyor 31 comprises an endless belt 26 circulating about rollers 27 mounted to frame 28. The infeed conveyor 31, wrapping conveyor 32 and take-off conveyor 33 all transport a load in the direction indicated by the arrow A. An alternate embodiment of the infeed conveyor could take the form of a hydraulic or pneumatic pushing device (not shown) which can be used to engage each load 24 with a platen to push the load into the wrapping area 40. However, the disclosed conveyor embodiment is preferred, and the belts of each conveyor of the present invention are preferably textured so that they have a high coefficient of friction against the load and any film web carried therewith.

Figure 2:
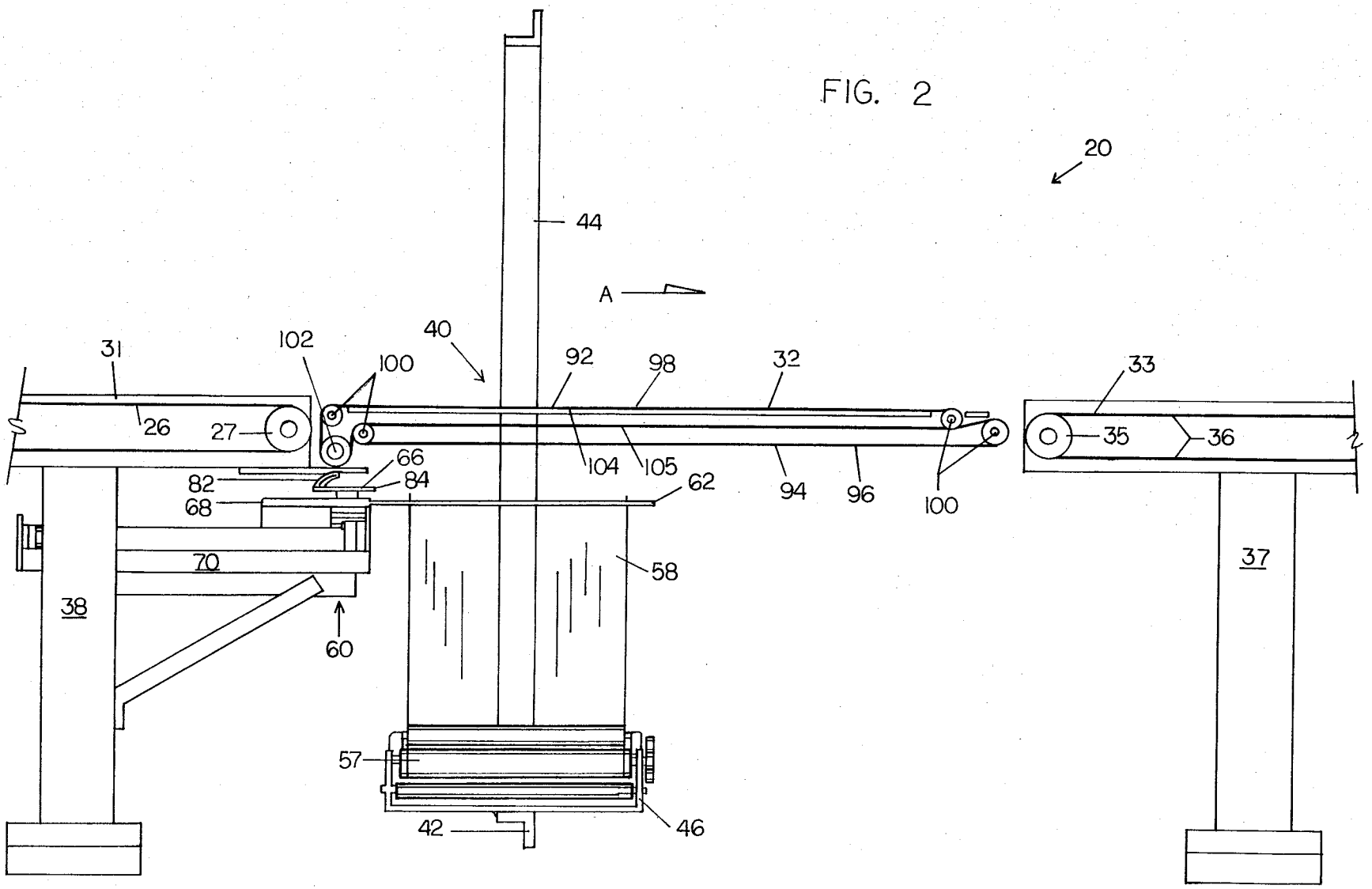
FIG. 2 is an opposite side view of a portion of the apparatus of FIG. 1, showing the infeed, wrapping and take-off conveyors together with the film dispensing mechanism and traveling clamp mechanism.

The particular arrangement of the conveyors set forth in FIGS. 1 and 2 accommodates random variation of total load size in all three dimensions. It is apparent, however, that other conveyor configurations could be constructed which would be advantageous for specific products. Thus, the conveyance of, for instance, six-packs of cans or bottles could be handled by a horizontal conveyor with guide conveyors on each side thereof.

Figure 3:
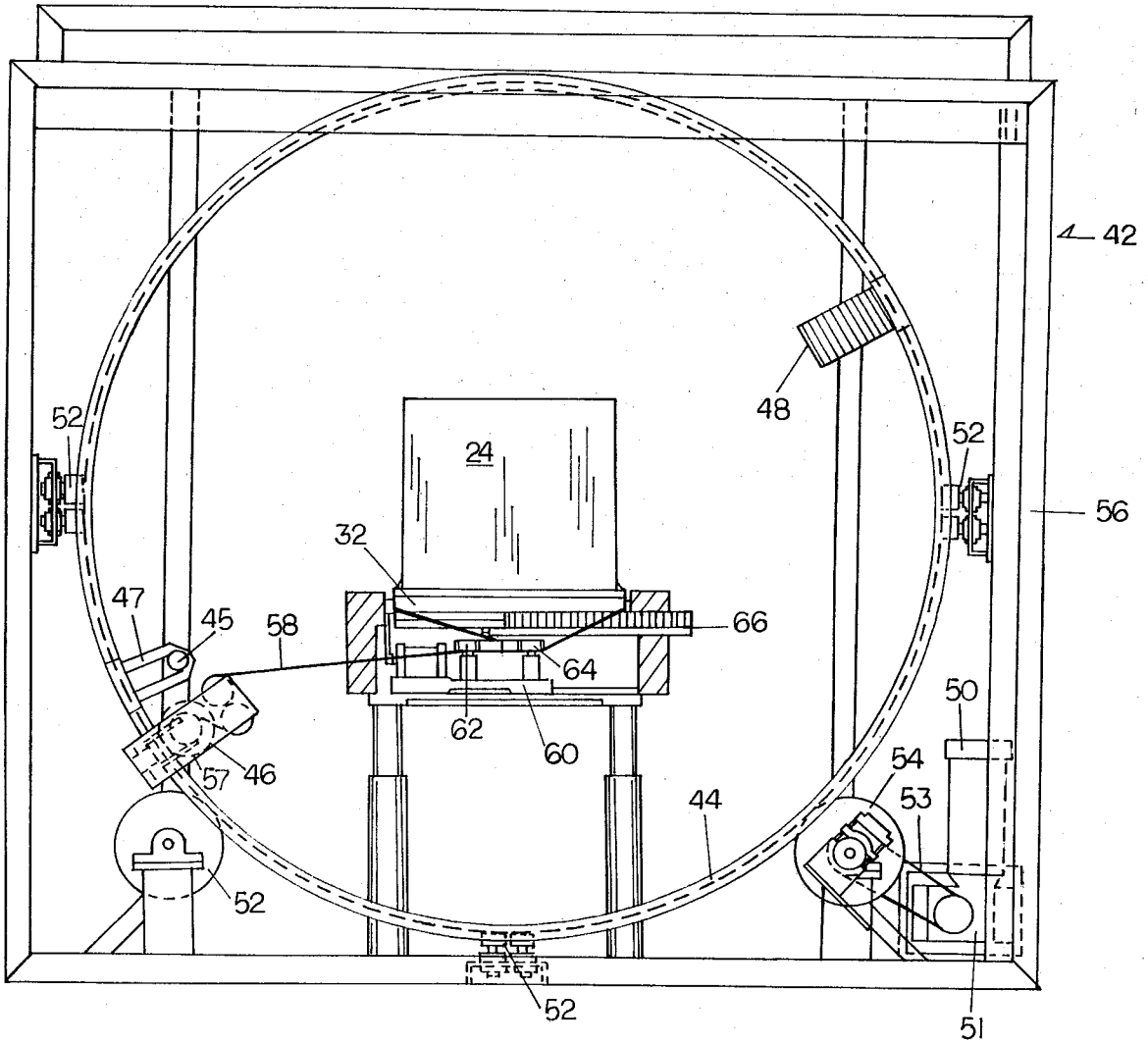
FIG. 3 is a rear elevational view of the film dispensing mechanism and wrapping conveyor of the apparatus of FIG. 1.

The infeed conveyor 31 delivers each load 24 into a wrapping area 40 atop wrapping conveyor 32, around which rotates film dispensing apparatus 42. As best seen in FIG. 3, film dispensing apparatus 42 comprises a ring-shaped film support member 44 rotatably mounted and supported on three planes by guide rollers 52 journalled to frame 56. If desired, the ring member 44 can be constructed of aluminum. A friction drive wheel 54 is positioned adjacent the ring member 44 at its base and engages the member 44 to rotate the member 44 within the plane defined by the guide wheels 52. The friction drive wheel 54 is driven by motor 50 having a shaft which is suitably connected through a reducer 51 and chain or belt 53 to wheel 54. As best seen in FIG. 2, a film carriage 46 is mounted across the ring member 44 and is adapted to receive and hold a film material roll 57.

Typical films which can be used in the stretch wrapping apparatus are EVA-Copolymer films with a high EVA content such as the films manufactured by Consolidated Thermoplastics "RS-50", Bemis "Super-Tough" and PPD "Stay-Tight" films. PVC films such as Borden Resinite "PS-26" can be used in the invention, as can premium films such as Mobil-X, Presto Premium and St. Regis which utilize a low pressure polymerization process resin manufactured by Union Carbide and Dow Chemical Company. This resin, called linear low-density polyethylene, has stretch characteristics which allow the film to withstand the high stress of extreme elongation without tearing during the load wrapping process.

It should be noted that the terms film, film material and film web are used interchangeably throughout the specification.

The film dispenser mechanism 46 is balanced on ring 44 by a counterbalance weight 48 mounted on ring 44 diametrically opposite film dispenser mechanism 46. The film dispenser mechanism 46 may be any suitable well-known mechanism adapted to dispense film web about the load 24 and wrapping conveyor 32 as the ring 44 is rotated by wheel 54. The film wrapping mechanism 46 may, for instance, comprise a brake which is urged against the film web roll 57 to place tension on film web 58 and stretch the same as it is drawn from the roll 57 to the load by rotation of the ring 44. Alternatively, the film web may be drawn through a plurality of rollers connected to operate at progressively higher surface speeds, in order to stretch the film web between the rollers prior to wrapping the load. Both of these types of film dispensing mechanisms 46 have been disclosed in U.S. Pat. No. 4,317,322 assigned to Lantech, Inc., which patent is incorporated herein by reference.

The wrapping conveyor 32, as best seen in FIGS. 1 and 2, comprises an upper stacked conveyor 92 atop a lower stacked conveyor 94. These conveyors are standard plate-type conveyors which are well-known in the art, and comprise a lower endless belt 96 and an upper endless belt 98 mounted on a plurality of free-wheel rollers 100. The upper surface of upper belt 98 is supported by belt plate 104 and is driven by rotation around drive roller 102 in a direction indicated by the arrow A. The upper surface of lower belt 96 is supported by belt plate 105 and is in frictional contact with and driven by the lower portion of upper belt 98. Thus, friction between the lower surface of upper belt 98 and the upper surface of lower belt 96 drives lower belt 96 such that the lower surface of lower belt 96 also travels in the direction indicated by the arrow A, and at the same speed as that of upper belt 98. Drive roller 102 may be driven by any conventional linkage such as chains or belts coupled to a drive motor, all of which is well-known in the art. The upper belt 98 and/or lower belt 96 can comprise multiple belts.

As best seen in FIG. 3, this construction allows film web to be stretched and dispensed from film dispensing mechanism 46 during rotation of ring 44, and wrapped about the wrapping conveyor 32 and the load 24 atop conveyor 32 under tension. Both the load and the film web 58 wrapped about the load and conveyor 32 are carried by the conveyor 32 in the same direction. The conveyor 32 may be operated during rotation of ring 44, in order to create a spiral wrap around the load 24 and conveyor 32. Alternatively, the conveyor 32 may be halted, and the ring 44 rotated in order to dispense a band of film web 58 around load 24 and conveyor 32. As will be seen below, multiple bands may be formed on a single load. If the film web is substantially the same width as the length of the load along conveyor 32, then a single band of web 58 will completely wrap the load in a full web wrap.

The end of the wrap cycle is determined in the present invention by a proximity switch 45 mounted on frame 56 and located a short distance away from ring 44. The proximity switch senses the passage of a bent metal plate 47 secured to the ring. The proximity switch is electrically connected to a counter which is activated to determine each revolution of wrap. One such counter which can be utilized with the invention is an Eagle counter, Model D2100-AG, an off-the-shelf standard apparatus. When the counter has indicated a predetermined number of revolutions depending on the type of wrap and the load desired to be wrapped, the counter activates a switch not shown which stops the takeoff conveyor and wrapping conveyor for cutting of the film web. It should be noted that the film roll 57 on ring 44 in the stop position is preferably located on a line with the load and the traveling clamp assembly.

Figure 4:
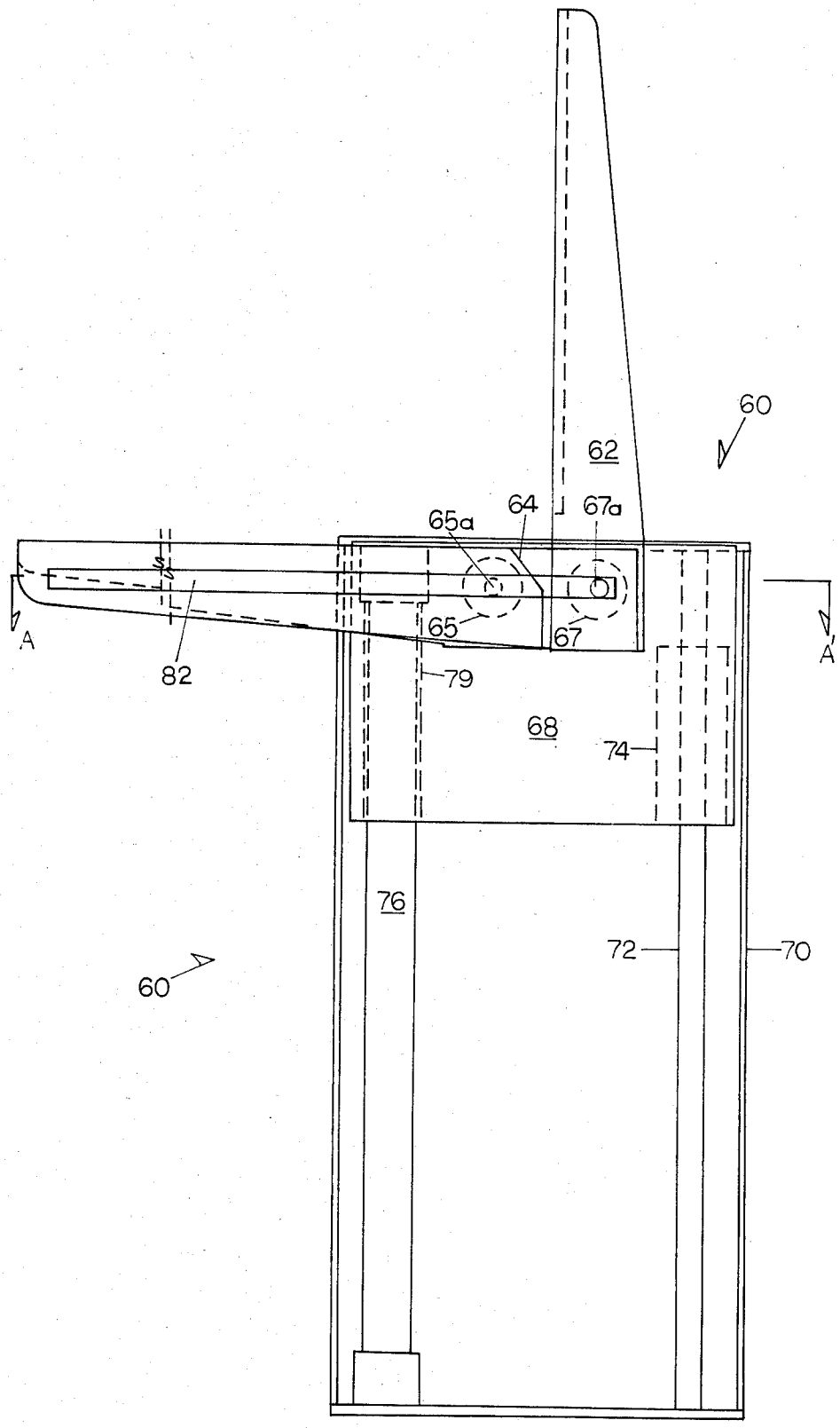
FIG. 4 is an isolated top plan view of the traveling clamp mechanism of the apparatus of FIG. 1.
Figure 5:
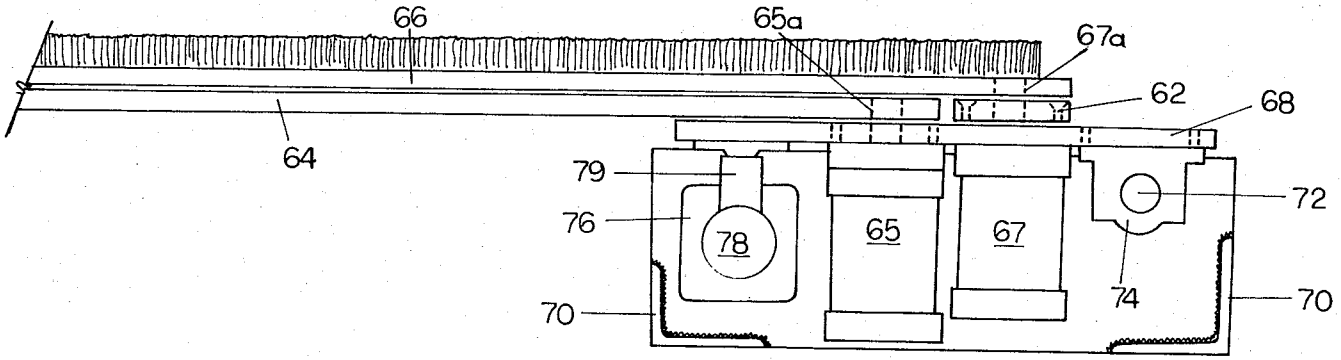
FIG. 5 is a cross-sectional view taken along line A–A' of the apparatus of FIG. 4.
Figure 6:
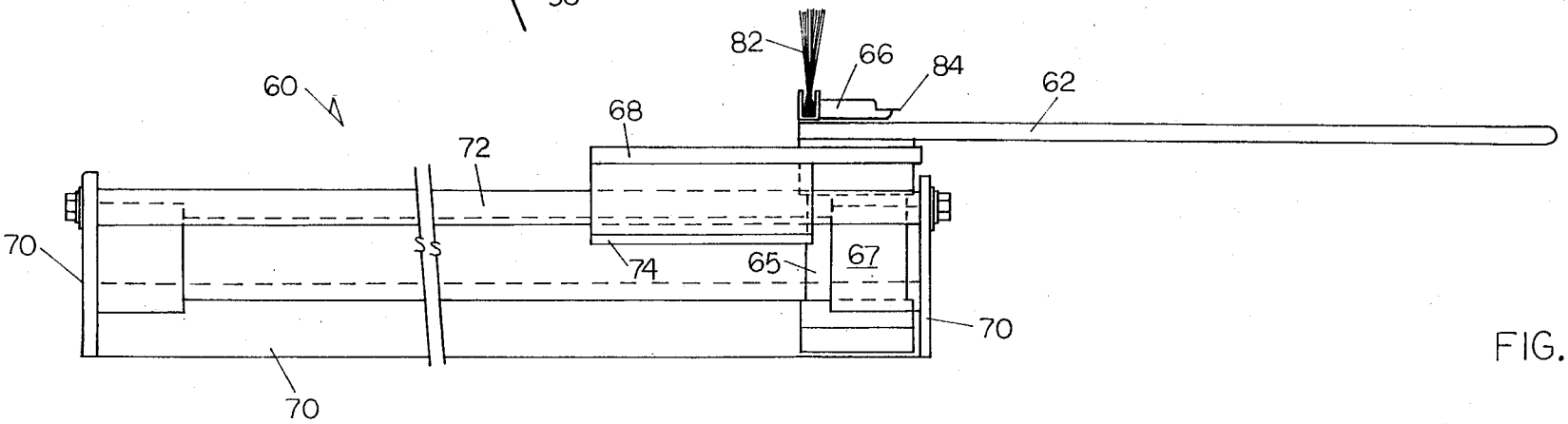
FIG. 6 is a side elevational view of the apparatus of FIG. 4.

The traveling clamp assembly 60 of the present invention is mounted to the infeed conveyor frame by a suitable support structure for extension into wrapping area 40. The construction of the traveling clamp assembly 60 is best illustrated in FIGS. 4 through 6. The assembly 60 comprises a fixed clamp frame 70, a linear bearing shaft 72 mounted within frame 70 and a driver 76 mounted within frame 70 parallel to shaft 72. A traveling base plate 68 is mounted to bearing housing 74 and drive rod mount 79 above shaft 72 and driver 76. Thus, driver 76 may be activated to transport the traveling base plate 68 linearly to one end or the other of frame 70. The driver 76 may be any conventional linear transportation drive such as a pneumatic or hydraulic cylinder system.

Figure 11:
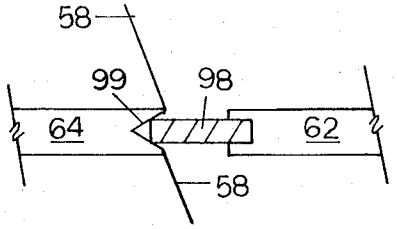
FIG. 11 is a cross-sectional view of the jaws of the apparatus of FIG. 4 in a closed position.

A fixed clamp jaw 62 and rotating clamp jaw 64 are mounted to the traveling base plate 68. The rotating jaw 64 is adapted to swing through an arc to close on fixed jaw 62 and clamp film web 58 therebetween. A radial actuator 65 is mounted beneath and carried by the traveling plate 68 and is connected to the jaw 64 by shaft member 65*a* for operation of the jaw 64 to and away from fixed jaw 62. As is shown in FIG. 11, the fixed clamp jaw 62 carries a deformable contact member 98 on one edge. The edge of jaw 64, which faces and closes on deformable member 98, defines a channel or groove 99. Thus, when jaw 64 is closed on jaw 62, film web 58 is sandwiched in contact between deformable member 98 and groove 99. It should be noted that deformable member 98 can be placed under compression by jaw 64 in order to maintain a firm grip on film web 58 during severance of the film web as will be later discussed. The deformable member 98 may be made of any appropriate natural or artificial substance, such as rubber.

As can best be seen in FIGS. 5 and 6, a cutter brush arm 66 is pivotally mounted atop fixed jaw 62. A radial actuator 67 mounted to and beneath traveling plate 68 is connected to the cutter brush arm 66 by shaft member 67*a* and is adapted to swing the cutter brush arm 66 through an arc in a plane directly above and parallel to that of rotating jaw 64. Radial actuators 65 and 67 may be of any appropriate well-known type for rotation of a lever-type element, such as air motors. Jaw 62 defines a major axis parallel to the direction of travel of plate 68, the axis also being parallel to the width of film web 58 extending from dispenser mechanism 46 to the load 24 when the ring 44 is in the stop position.

A cutting edge 84 is mounted to arm 66 so that it projects ahead of arm 66 as the same as rotated into position above jaw 62 by radial actuator 67. A film web brush 82 is mounted in a channel member 81 secured to the rear edge of arm 66 opposite cutting edge 84.

Figure 7:
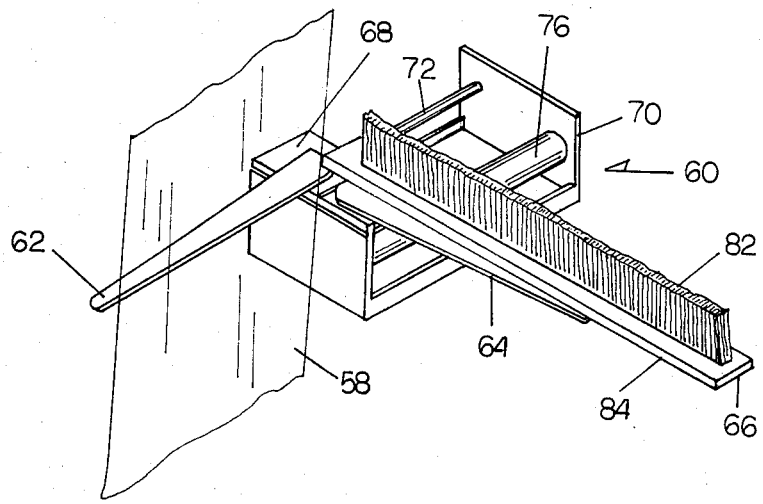
FIG. 7 is an elevated perspective view of the apparatus of FIG. 4 in an initial stage of operation.
Figure 8:
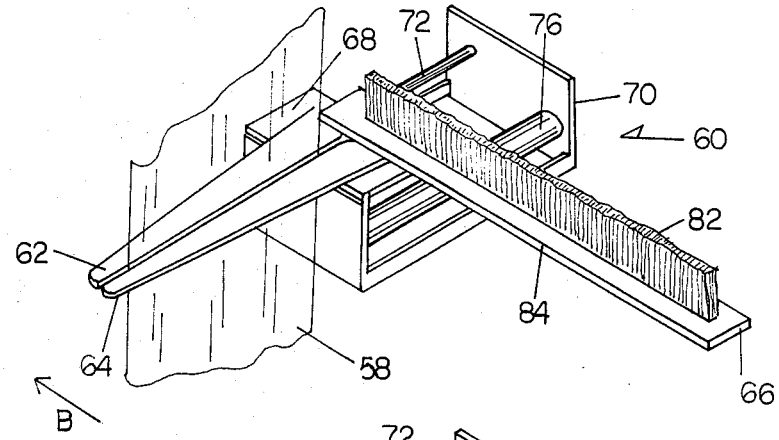
FIG. 8 is an elevated perspective view of the apparatus of FIG. 4 in a stage of operation subsequent to that of FIG. 7.

The operation of the traveling clamp assembly 60 is best understood by reference to FIGS. 7 through 10. As shown in FIG. 7, the film dispensing mechanism 46 is positioned directly beneath the load 24, conveyor 32 and assembly 60 by rotation of ring 44 and the drive cylinder 76 is activated to drive plate 68 forward. While the ring was rotating, the traveling clamp assembly began traveling forward on the last wrap to engage the film web and begin the clamping and cutting cycle. Fixed jaw 62 extends into the wrapping area adjacent web 58, while the rotating jaw 64 and cutter brush arm 66 are maintained in an open position, rotated away from jaw 62. In FIG. 8, the radial actuator 65 has been activated to rotate jaw 64 to close on jaw 62 holding film web 58 therebetween. Motor 50 is then activated to rotate ring 44, and a band of stretched film web 58 is dispensed by mechanism 46 around the load 24, conveyor 32 and jaws 62 and 64. The web is dispensed in the direction indicated by the arrow B in FIG. 8. At the end of one and one quarter revolutions of ring 44, the jaw 64 is then swung partly open and away from jaw 62 by action of radial actuator 65 releasing the clamp on film web 58. The drive cylinder 76 is activated to draw plate 68 and fixed jaw 62 to the opposite end of frame 70, thus removing jaw 62 from the wrapping area 40. Jaw 64 is then completely opened. The previously tensioned stretched web 58 seeks its original memory and constricts against the lower surface of lower conveyor 96 and holds the original end of web 58 there. Rotation of ring 44 and wrapping of film web 58 about the load and the conveyor 32 continues, and the conveyor 32 may be activated to carry the load through the wrapping area to create a spiral wrapping configuration.

The conveyors 32 and 33 are spaced apart slightly to define a gap. As the wrapped load encounters the gap, the film web 58 wrapped beneath conveyor 94 will ride up through the gap to collapse against the underside of the load. Thus, the take-off conveyor 33 will transport a completely wrapped load.

When wrapping of the load 24 is completed, ring 44 is brought to a halt with dispensing mechanism 46 against directly below the wrapping area. As previously mentioned and referring again to FIG. 7, cylinder 76 is again activated to carry jaw 62 into the wrapping area, with jaw 64 being open while the ring 44 and the film dispensing mechanism 46 are still moving. One side of the jaw 62 slides into the path of the film web and as the film web moves against that side, jaw 64 comes in to clamp the film web 58 therebetween. As is seen in FIG. 8, radial actuator 65 is activated to close jaw 64 on jaw 62, securing film web 58 therebetween.

Figure 9:
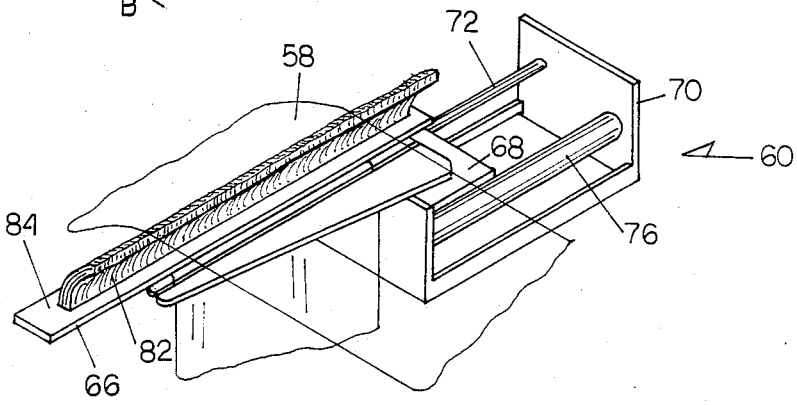
FIG. 9 is an elevated perspective view of the apparatus of FIG. 4 in a stage of operation subsequent to that of FIG. 8.

In FIG. 9, radial actuator 67 mounted to base plate 68 is activated to rotate shaft 67*a* and cutter brush arm 66 into contact with the film web 58 extending between the load and jaws 62 and 64. The cutting edge 84 which leads the cutter brush arm 66 contacts and severs the film web 58 above the jaws 62 and 64. Cutting edge 84 may be any conventional well-known cutting edge such as a saw blade, knife blade or heated nichrome wire. As arm 66 rotates to cut film web 58, brush 82 mounted atop arm 66 brushes the portion of the web 58 attached to the load against the lower surface of lower conveyor 96, which has been previously wrapped with one or more layers of film web 58. The contact of the film web 58 on the underlying layer creates an adequate seal for the wrapped load due to the tackiness of the film web. The conveyor 32 is then activated to carry the wrapped load 24 completely onto take-off conveyor 33. If it is desired to create a band wrap further along the load 24, then conveyor 32 transports the load only partly through the wrapping area.

Arm 66 may be of any length equal to or greater than the width of film web 58 in order to sever the film web completely. Jaws 62 and 64 need grasp only a portion of the width of film web 58 to maintain sufficient tension across the whole width for severance by edge 84.

Figure 10:
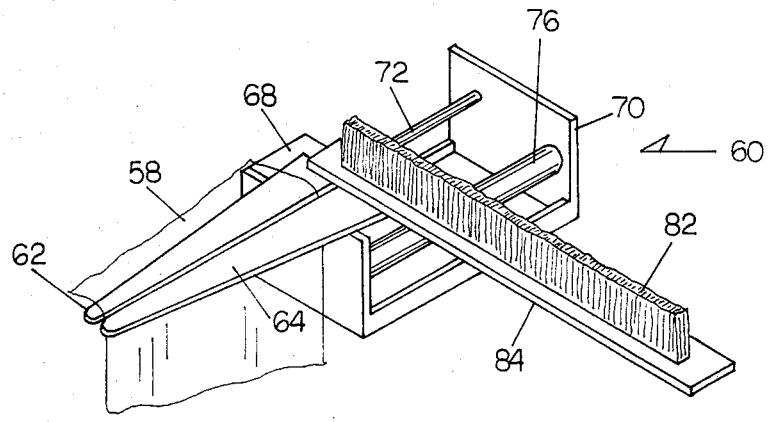
FIG. 10 is an elevated perspective view of the apparatus of FIG. 4 in a stage of operation subsequent to that of FIG. 9.

In the final step of the operation as shown in FIG. 10, the radial actuator 67 is again activated to rotate shaft 67*a* and swing arm 66 backward to its original open position, thus leaving the new leading end of film web 58 clamped between jaws 62 and 64, as shown in FIG. 8. The apparatus 20 is then ready to repeat the wrapping cycle with a subsequent load 24 or, in the case of band wrapping, with the same load.

In the foregoing description, the invention has been described with reference to a particular preferred embodiment, although it is to be understood that the specific details shown are merely illustrative, and the invention may be carried out in other ways without departing from the true spirit and scope of the following claims:

What is claimed is:

1. Apparatus for wrapping a load comprising infeed means adapted to receive a load, wrapping means positioned adjacent said infeed means comprising a frame, a film dispensing means configured as a planar ring and rotatably mounted to said frame, said film dispensing means when rotated defining a wrapping area, a load holding means positioned within said wrapping area and adapted to receive a load from said infeed means and carry said load through said wrapping area in a downstream direction, said film dispensing means being adapted to hold a roll of film material and wrap said film material around said load and said load holding means, film stretching means mounted to said film dispensing means so as to be bisected by said planar ring and adapted to engage said film material to substantially stretch said film material being dispensed from said film dispensing means, traveling clamp assembly means comprising a first jaw means fixed in a line of travel and a second jaw means pivotably mounted to swing between contact with said first jaw means and an open position apart from said first jaw means, said jaw means being adapted to releasably clamp and hold said film material adjacent said load between said first and second jaw means, said traveling clamp assembly means being adapted to move along said line of travel into and out of said wrapping area, and cutter means adapted to move in a plane parallel to said jaw means and sever said film material held between said jaw means and said load.

2. Apparatus as claimed in claim 1 wherein said jaw means comprising a fixed jaw and a rotating jaw.

3. Apparatus as claimed in claim 2 wherein said fixed jaw defines a major axis parallel to said downstream direction.

4. Apparatus as claimed in claim 1 further comprising infeed frame means, said infeed means being mounted to said infeed frame means, said traveling clamp assembly means also being mounted to said infeed frame means.

5. Apparatus as claimed in claim 1 wherein said load holding means comprises at least one upper conveyor and at least one lower conveyor positioned within said wrapping area in a vertically stacked relationship and driven at a substantially uniform speed, said at least one upper conveyor being adapted to receive a load from said infeed means and transport said load in said downstream direction at said substantially uniform speed, said at least one lower conveyor being adapted to transport film material dispensed from said film dispensing means about the load and said at least one lower conveyor in said downstream direction at said substantially uniform speed.

6. Apparatus as claimed in claim 1 further comprising takeoff conveyor means spaced apart from said load holding means, and being adapted to receive wrapped loads from said load holding means.

7. Apparatus as claimed in claim 1 wherein said traveling clamp assembly means further includes brush means, said brush means being adapted to rotate in an arc between said jaw means and said load, said brush means being provided with cutter means mounted to a leading edge of said brush means, and a brush member mounted to said brush means behind said cutter means.

8. Apparatus as claimed in claim 1 wherein said traveling clamp assembly further comprises a frame, a linear bearing assembly means mounted to said frame, linear drive means mounted to said frame parallel to said linear bearing assembly means, traveling plate means mounted to said linear bearing assembly means and adapted to be driven linearly by said linear drive meas, said jaw means, cutter means, and brush means being mounted to said traveling plate means, jaw motor means mounted to said traveling plate means adapted to open and close said jaw means, and cutter brush motor means mounted to said traveling plate means and adapted to swing said cutter means and said brush means into and out of said wrapping area.

9. Apparatus for wrapping and utilizing a load with a wrap of substantially stretched film web, comprising a wrapping means, a load holding means, and a traveling clamp assembly, said wrapping means comprising a frame and a ring means rotatably mounted on said frame, said ring means when rotated defining a wrapping area, said load holding means being adapted to carry a load through said wrapping area, a film carriage mounted across said ring means and adapted to dispense substantially stretched film web around said load and said load holding means during rotation of said ring means, said traveling clamp assembly means comprising driver means and first and second jaw means, said driver means being adapted to linearly transport said first jaw means through said ring means to intercept said film web between said film carriage and said load, said second jaw means being adapted to swing to contact said first jaw means and thereby clamp said web extending between said load and said film carriage, and cutter means adapted to swing parallel to said jaw means and cut said film web between said load and said jaw means.

10. Apparatus as claimed in claim 9 wherein said jaw means is adapted to releasably clamp and hold at least a portion of the width of said film web.

11. Apparatus as claimed in claim 9 wherein said cutter means is adapted to sever the entire width of said film web.

12. Apparatus as claimed in claim 11 wherein said cutter means includes knife-edge means.

13. Apparatus as claimed in claim 11 wherein said cutter means comprises heatable means.

14. Apparatus as claimed in claim 9 wherein said jaw means comprises a fixed jaw transported linearly adjacent said film web, and a swinging jaw adapted to swing through an arc to engage said film web against said fixed jaw.

15. Apparatus as claimed in claim 9 wherein said cutter means comprises cutter arm means, and cutter brush means mounted to said cutter arm means adapted to swing through an arc to engage the full width of said film web, a cutter blade mounted to a leading edge of said cutter arm means, and brush means mounted to said cutter arm means.

16. Apparatus for wrapping a load comprising load holding means adapted to receive a load and carry said load in a downstream direction, ring means positioned about said load holding means and adapted to rotate about said load holding means, film carriage means mounted to said ring means and adapted to hold a roll of film material and wrap said film material from said roll about said load and said load holding means when said ring means is rotated, film stretching means mounted to said ring adapted to engage said film material and substantially stretch said film material dispensed from said film carriage means, traveling clamp assembly means adapted for movement on a line parallel to said downstream direction into and out of said wrapping area and comprising a first jaw fixed on said line and a second jaw movable to meet said first jaw and thereby to releasably clamp and hold said film material between said film carriage means and said load, and cutter means movable parallel to said jaw means to sever said film material between said film carriage means said load and to wipe said severed material against said wrapped material.

17. Apparatus as claimed in claim 16 wherein said load holding means comprises at least an upper conveyor and lower conveyor, said upper conveyor being adapted to transport said load in said downstream direction at a substantially uniform speed, said lower conveyor being adapted to transport film material dispensed from said film carriage means about said load and said lower conveyor in said downstream direction at said substantially uniform speed.

18. Apparatus as claimed in claim 17 further comprising conveyor drive means, said upper conveyor comprising at least one first endless belt means, said at least one first endless belt means being driven by said conveyor drive means, said lower conveyor comprising at least one second endless belt means, said at least one second endless belt means being in substantial contact with said at least one first endless belt means and being driven by friction with said at least one first endless belt means.

19. Apparatus as claimed in claim 18 wherein said ring means defines a plane, and said traveling clamp assembly means is adapted to move said plane and engage said film material adjacent said lower conveyor.

20. Apparatus as claimed in claim 16 wherein said ring means defines a plane, and said traveling clamp assembly means is adapted to move through said plane to engage said film material.

21. Apparatus as claimed in claim 20 wherein said traveling clamp assembly means is adapted to move through said plane in a direction parallel to said downstream direction.

* * * * *